US008470165B2

(12) United States Patent
Cosyns et al.

(10) Patent No.: US 8,470,165 B2
(45) Date of Patent: Jun. 25, 2013

(54) PROCESS FOR THE PRODUCTION OF HIGH-QUALITY KEROSENE AND DIESEL FUELS FOR THE COPRODUCTION OF HYDROGEN FROM SATURATED LIGHT CUTS

(75) Inventors: Jean Cosyns, Maule (FR); Annick Pucci, Croissy sur Seine (FR); Quentin Debuisschert, Rueil Malmaison (FR); Fabienne Le Peltier, Rueil Malmaison (FR)

(73) Assignee: IFP Energies Nouvelles, Rueil-Malmaison Cedex (FR)

( * ) Notice: Subject to any disclaimer, the term of this patent is extended or adjusted under 35 U.S.C. 154(b) by 250 days.

(21) Appl. No.: 12/944,981

(22) Filed: Nov. 12, 2010

(65) Prior Publication Data

US 2011/0114538 A1 May 19, 2011

(30) Foreign Application Priority Data

Nov. 13, 2009 (FR) ..... 09 05465

(51) Int. Cl.

| | |
|---|---|
| ***C10G 69/08*** | (2006.01) |
| ***C10G 59/02*** | (2006.01) |
| ***C10G 63/02*** | (2006.01) |
| ***C10G 50/00*** | (2006.01) |
| ***C07C 2/12*** | (2006.01) |
| ***C07C 2/18*** | (2006.01) |

(52) U.S. Cl.

USPC ..... 208/66; 208/49; 208/62; 208/134; 208/137; 585/330

(58) Field of Classification Search

USPC ..... 208/4, 60, 62, 66, 134, 137; 585/330

See application file for complete search history.

(56) References Cited

U.S. PATENT DOCUMENTS

| | | | | |
|---|---|---|---|---|
| 3,909,451 | A | 9/1975 | Wilhelm | |
| 4,006,197 | A * | 2/1977 | Bieser | 585/825 |
| 4,036,745 | A * | 7/1977 | Broughton | 208/310 Z |
| 4,423,269 | A * | 12/1983 | Miller | 585/533 |
| 4,542,247 | A * | 9/1985 | Chang et al. | 585/533 |
| 4,677,237 | A * | 6/1987 | Imai et al. | 585/444 |
| 4,678,645 | A * | 7/1987 | Chang et al. | 422/610 |
| 5,714,661 | A * | 2/1998 | Tuli et al. | 585/330 |

(Continued)

FOREIGN PATENT DOCUMENTS

| | | |
|---|---|---|
| GB | 2 186 287 A | 8/1987 |
| WO | WO 93/03116 A1 | 2/1993 |

OTHER PUBLICATIONS

Search Report of FR 0905465 (Jun. 15, 2010).

M Stockle et al., "Dealing with Dieselisation," ERTC 14th Annual Meeting—Berlin—Nov. 2009 (Nov. 11, 2009) XP002587070.

*Primary Examiner* — Nina Bhat

*Assistant Examiner* — Jonathan Miller

(74) *Attorney, Agent, or Firm* — Millen, White, Zelano & Branigan, P.C.

(57) ABSTRACT

Process for the production of high-quality kerosene and diesel fuels and for the coproduction of hydrogen from a so-called light naphtha cut to which any quantity of LPG cut can be added where the steps of the process include: separating normal and iso-paraffins, dehydrogenation of the paraffins, oligomerization of the olefins and hydrogenation of the oligomerized olefins, the process permitting the production of kerosene and diesel fuels meeting market specifications, or even improved relative to the latter.

16 Claims, 1 Drawing Sheet

U.S. PATENT DOCUMENTS 5,847,252 A * 12/1998 Stine et al. ..... 208/64
5,856,604 A * 1/1999 Stine et al. ..... 585/310
5,998,685 A * 12/1999 Nierlich et al. ..... 585/329
6,025,533 A * 2/2000 Vora et al. ..... 585/330
6,398,946 B1 * 6/2002 O'Rear et al. ..... 208/64
6,875,900 B2 * 4/2005 Koves ..... 585/510
6,897,345 B2 * 5/2005 Marchionna et al. ..... 585/315
7,456,130 B2 * 11/2008 Galperin et al. ..... 502/326
2003/0073875 A1 * 4/2003 Ryu et al. ..... 585/331
2007/0255081 A1 * 11/2007 Beadle et al. ..... 585/509

* cited by examiner

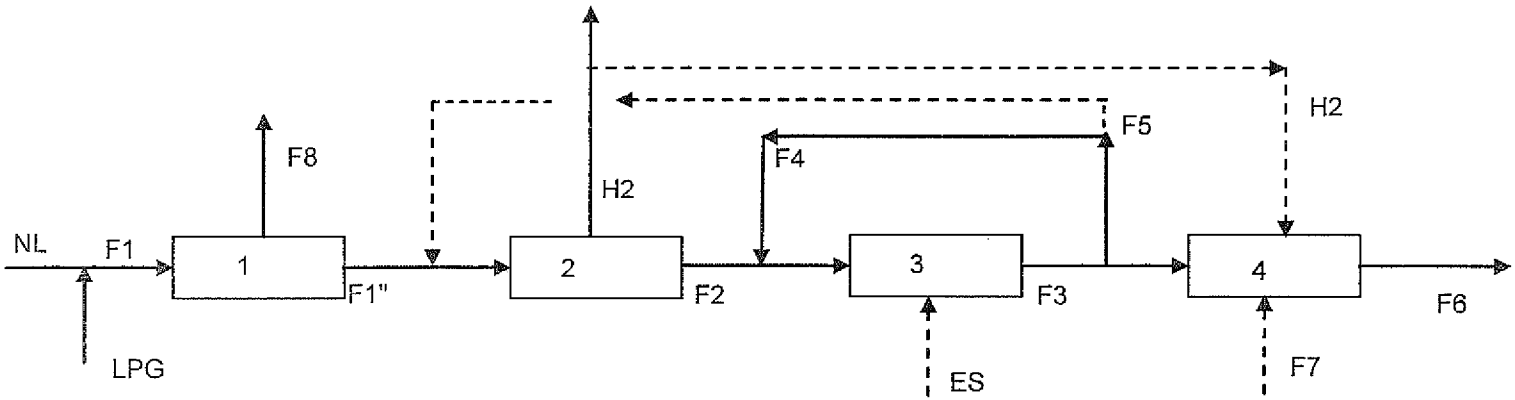
NL
F1
LPG
1
F8
F1"
2
H2
F2
F4
3
ES
F3
F5
4
H2
F7
F6

PROCESS FOR THE PRODUCTION OF HIGH-QUALITY KEROSENE AND DIESEL FUELS FOR THE COPRODUCTION OF HYDROGEN FROM SATURATED LIGHT CUTS

INTRODUCTION

The development of automobile engines is currently seeing an increase in demand for diesel fuel at the expense of the demand for gasoline.

Forecasts for the development of the market for automotive fuels indicate a near-global decrease in demand for gasoline. Thus, whereas in 2000 the ratio of consumption of gasoline to that of diesel was 2, it is forecast to be close to 1.5 in 2015. For the European Union, there is actually a sharp decrease, since this ratio, which was 1 in 2000, should reach 0.5 in 2012.

Moreover, demand for kerosene should also increase significantly in the near future in connection with the development of the air transport market.

This inevitable evolution towards increased demand for middle distillates, and reduction in the demand for gasoline, presents the refining industry with a serious problem of adapting supply to demand, and in a very short time, which is hardly compatible with the construction of new installations that are expensive and take a long time to bring on stream, such as units for the hydrocracking of gas oil under vacuum.

The present invention proposes an attractive solution for meeting increased demand for diesel fuel and kerosene on the basis of light naphtha (including any proportion of so-called LPG cut $C_3$ and $C_4$), without requiring expensive new hydrocracking units.

The solution described in the present invention is particularly suitable to adaptation of existing refining processes.

Furthermore, it can also generate hydrogen, demand for which is increasing in refineries in order to satisfy the increased capacities of the hydrotreatment units for producing reformulated fuels (specifications Euro 3, 4, 5 or CARB I, II).

PRIOR ART

In a market dominated by gasoline consumption, such as in the United States, the production of diesel fuel is provided essentially from so-called "straight run" middle distillates, i.e. obtained from the direct distillation of crude.

These middle distillates must be hydrotreated to meet the current very stringent specifications on sulphur content (10 ppm max.) and contents of aromatics. At present production is manifestly insufficient and obliges refiners in certain geographical zones, and in particular in Europe, to import diesel fuel to meet domestic demand.

Conversely, and particularly in Europe, refiners are faced with surpluses of gasoline, exports of which to the geographical zones where there is a deficit are uncertain in the short term with the increase in refining capacities and/or decline in consumption in the zones in question.

For all these reasons, some refiners have built hydrocracking units, which can convert heavy cuts such as vacuum gas oil to diesel fuel of very good quality. Nevertheless, this process is very expensive in capital expenditure and utilities as it operates at very high pressure (above 100 bar), and requires a very high consumption of hydrogen (of the order of 10 kg to 30 kg of hydrogen per tonne of feed), necessitating building a specific plant for the production of hydrogen.

This unit for the production of hydrogen is generally a unit for the steam reforming of methane or petroleum gas (LPG), more rarely a unit for the oxycombustion of various petroleum cuts.

Whatever unit is adopted for the production of hydrogen, this plant represents a very big investment and necessitates importing expensive raw materials.

The present solution can be regarded as an alternative to the "hydrocracking" solution and only requires units with lower capital expenditure and which in addition generate hydrogen.

From the prior art concerning the production of gasoline from cuts in the range $C_3$-$C_7$, there can be mentioned:

- patent GB 2 186 287, which discloses a process for the production of a gasoline cut and a kerosene cut from a feedstock comprising 4 carbon atoms, such as a butane fraction from catalytic cracking, said process comprising dehydrogenation of the feed, followed by oligomerization of the effluent from dehydrogenation and separation of the effluent from oligomerization to obtain hydrogen.
- patent US 2003/073875 A1, which describes a process for the production of gasoline comprising separation of iso-alkanes and normal alkanes prior to dehydrogenation of the normal alkanes to olefins and comprising an alkylation reaction of the olefins to iso-alkanes.
- the document "Dealing with dieselisation" by Mike Stockle and Tina Knight, from the 14th ERTC Congress in Berlin on 11 Nov. 2009, which discloses a process for the production of kerosene by dehydrogenation of a light naphtha cut and a saturated LPG cut, oligomerization of the product and recycling of the $C_5$-$C_8$ fraction of the oligomerized effluent.

BRIEF DESCRIPTION OF THE INVENTION

The present invention makes it possible to produce mainly a kerosene or diesel fuel of high quality using a succession of processes that also offers production of hydrogen. The latter aspect is very important because, generally speaking, the refinery's demand for hydrogen is constantly increasing owing to the development of various hydrotreatment units that are required in order to meet the specifications for final sulphur content (10 ppm by weight).

In the present invention, the feed is constituted by a so-called light naphtha cut, to which any proportion of $C_3$ or $C_4$ cut, the so-called "LPG" cut, can be added. The "light naphtha" cut (labelled NL on the process flowsheet) corresponds to a number of carbon atoms in the range from 5 to 7, and correspondingly to a boiling point in the range from 50° C. to 120° C.

Hereinafter, the feed of the present process will mean a hydrocarbon feed in the range from $C_3$ to $C_7$.

It is assumed that the light naphtha cut (NL) is previously hydrotreated so as to remove any nitrogen-containing and sulphur-containing impurities that it might contain.

The $C_3$-$C_7$ feed is sent to a unit for separating normal and iso-paraffins (1). To avoid any ambiguity, normal paraffins are linear paraffins, and iso-paraffins are paraffins having at least one branching.

This unit for separating normal and iso-paraffins (1) is installed when the aim is to produce diesels with high octane number above 45 using zeolites in the oligomerization unit (3). This arrangement also offers the advantage of producing gasoline with a much improved octane number relative to the starting naphtha, corresponding to the stream of iso-paraffins (F8).

The normal paraffins thus obtained (F1)" are then sent to a dehydrogenation unit (2), which produces hydrogen (H2), and an effluent (F2) mainly containing olefins, as well as unconverted paraffins.

The olefin-rich cut (F2) obtained at the end of stage 2 is then sent to an oligomerization unit (3), which mainly produces a cut of olefins (F3) with a number of carbon atoms typically in the range from $C_{10}$ to $C_{24}$, boiling in the distillate range, i.e. in a temperature range between 150° C. and 380° C.

The cut leaving the oligomerization unit (3) is called diesel cut hereinafter. It can optionally be restricted, by fractionation or by varying the severity of the oligomerization unit (3), to a cut with a distillation range between 150° C. and 310° C., called kerosene.

In addition, at the outlet of the oligomerization unit (3) a gasoline fraction of boiling point below 150° C. is obtained, in smaller quantity than the starting light naphtha, and moreover with an improved octane number, or even much improved when the optional unit for separating normal and iso-paraffins (1) is used.

It is possible to treat simultaneously, in the oligomerization unit (3), any olefinic refinery cut in the range from $C_3$ to $C_{10}$ (labelled ES), for example the olefinic cuts from a catalytic cracking unit (labelled with the abbreviation FCC), or from a steam cracking unit, or from a coking unit or visbreaker, or also from a Fischer-Tropsch unit.

The diesel or kerosene cut (F3) from the oligomerization unit (3) is sent to a hydrogenation stage (4), which depending on the catalytic system used makes it possible to obtain an excellent kerosene fuel or a diesel cut with a cetane number above 45, containing neither sulphur, nor polyaromatics, and having an aromatics content below 10%.

A proportion of the hydrogen produced in stage (2) can serve as makeup in the hydrogenation stage (4).

The present invention makes it possible to treat simultaneously, in the hydrogenation unit (4), any cut with a boiling point above 150° C. and preferably between 150° and 380°, originating from the refinery (labelled F7), for example cuts originating directly from the unit for the atmospheric distillation of crude, or from a catalytic cracking unit (labelled with the abbreviation FCC), or from a hydrocracking unit or from a unit for catalytic reforming of gasolines, so as to hydrogenate their aromatics (in addition to the olefins) with a beneficial effect on the quality of the resultant kerosene (improvement of the smoke point) or of the resultant diesel (improvement of the cetane number).

The hydrogenation unit (4) preferably uses technology operating at low temperature, primarily in the liquid phase, offering a saving on capital costs and an improvement in performance in terms of cetane number of the diesel cut relative to conventional processes of hydrotreatment operating in the gas phase.

Nevertheless, if said conventional hydrotreatment unit is available on the site, it can be utilized for carrying out the hydrogenation stage (4).

In the case of a hydrogenation unit (4) employing low-temperature technology and liquid phase, the sulphur content of the feed to the hydrogenation unit will be less than 5 ppm by weight, and preferably less than 1 ppm by weight.

The characteristics of the improved, sulphur-free diesel cut produced using zeolites in the oligomerization unit (3) are as follows:

95 vol. % point ASTM D86 below 360° C.
cetane number above 45
flash point above 55° C.
polyaromatics content below 5 vol. %.

The characteristics of the improved, sulphur-free kerosene cut produced using non-zeolitic acid catalysts as described previously in the oligomerization unit (3), are as follows:

ASTM D86 final boiling point below 300° C.
smoke point above 30 mm
freezing point below −60° C.
flash point above 38° C.

More precisely, the present invention can be defined as a process for the production of kerosene and diesel fuels and for the coproduction of hydrogen from a light unsaturated feed (F1) with a number of carbon atoms between $C_3$ and $C_7$ and constituted by:

a) a light naphtha cut (NL) with a number of carbon atoms in the range from 5 to 7 originating from units for primary distillation, hydrocracking or from a Fischer-Tropsch unit, with a distillation range between 30° C. and 120° C., said light naphtha cut being previously hydrotreated or treated to remove oxygen-containing, nitrogen-containing, and sulphur-containing compounds and b) a $C_3/C_4$ cut (called "LPG") present in any proportion, said process comprising the following successive stages:

a stage of dehydrogenation (2) of the feed operating at a pressure between 1.3 and 5 bar absolute, and at a temperature between 400° C. and 700° C., preferably between 500° C. and 600° C., and employing a dehydrogenation catalyst constituted by a group VIII precious metal selected from platinum, iridium, rhodium, and at least one promoter selected from the group constituted by tin, germanium, lead, gallium, indium, thallium, said precious metal and said promoter being deposited on an inert support selected from the group formed by silica, alumina, titanium oxide, silica-magnesia, or any mixture of said constituents, said dehydrogenation stage (2) making it possible to recover an effluent (F2) essentially constituted by olefins with a number of carbon atoms between 3 and 7, called olefinic effluent (F2), a stage of oligomerization (3) of some or all of the olefinic effluent (F2) obtained in stage (2) in an oligomerization unit (3) employing an oligomerization catalyst selected from the group formed by solid phosphoric acid, ion exchange resins, silica-aluminas or aluminosilicates such as zeolites, pure or supported on alumina, said oligomerization stage (3) making it possible to recover an effluent (F3) in the majority constituted by olefins in the range from $C_{10}$ to $C_{25}$, and a "gasoline" effluent (F4) in the majority constituted by paraffins in the range from $C_5$ to $C_{10}$, which is separated from effluent (F3) by distillation and recycling to the inlet of the oligomerization unit (3), a stage of hydrogenation (4) of the olefinic effluent (F3) from the oligomerization stage (3) carried out in the liquid phase in one or more fixed-bed reactors, at temperatures between 50° C. and 300° C., and preferably between 100° C. and 200° C., and at pressures from 5 to 50 bar, and preferably from 10 to 30 bar (1 bar=$10^5$ Pa), and employing a hydrogenation catalyst based on a metal selected from the group formed by platinum, palladium or nickel deposited on an inert support such as silica or alumina, or any mixture of these two components, said hydrogenation stage making it possible to recover an effluent (F6), which is a cut of diesel or kerosene fuel that is in the majority paraffinic.

In a first variant of the process according to the invention, the catalyst used in the dehydrogenation stage (2) is constituted by platinum and tin deposited on an alumina neutralized with an alkali.

In another variant of the process according to the invention, the hydrogen used during stage (4) of hydrogenation comes at least partly from the hydrogen generated in stage (2).

The process according to the invention can more particularly be oriented towards the production of diesel fuel with a high cetane number. In this case, the feed (F1) is introduced upstream of the dehydrogenation unit (2) in a unit for separating normal and iso-paraffins (1), employing a molecular sieve based on small-pore alkaline zeolites such as those designated 5A, making it possible to recover a first effluent (F1)" essentially constituted by normal paraffins sent to the dehydrogenation stage (2) and a second effluent (F8) essentially constituted by iso-paraffins, which is sent to the gasoline pool or is upgraded to petrochemical naphtha, the dehydrogenation stage (2) being carried out at a pressure between 1.3 and 5 bar absolute, and at a temperature between 400° C. and 700° C., and preferably between 500° C. and 600° C., and employing a dehydrogenation catalyst constituted by a group VIII precious metal selected from platinum, iridium, rhodium, and a promoter selected from the group constituted by tin, germanium, lead, gallium, indium, thallium, said precious metal and said promoter being deposited on an inert support selected from the group formed by silica, alumina, titanium oxide, silica-magnesia, or any mixture of said components, the oligomerization stage (3) being carried out on a zeolite catalyst at temperatures between 150° C. and 500° C. and preferably between 200° C. and 350° C., and at pressures from 10 to 100 bar, and preferably from 20 to 65 bar, the hydrogenation stage (4) being carried out in the liquid phase, at temperatures between 50° C. and 300° C., and preferably between 100° C. and 200° C., and at pressures from 5 bar to 50 bar, and preferably from 10 bar to 30 bar, and employing a hydrogenation catalyst based on a metal selected from the group comprising platinum, palladium or nickel deposited on an inert support such as silica or alumina, or any mixture of these two components.

In another variant of the present invention, the process according to the invention can more particularly be oriented towards the production of kerosene fuel to JET A1 specifications. In this case, the oligomerization stage (3) is carried out on resins at temperatures between 20° C. and 200° C., and preferably between 70° C. and 180° C., and at pressures from 10 bar to 100 bar, and preferably from 30 bar to 65 bar.

Still in the case of a process oriented towards the production of kerosene to JET A1 specifications, the oligomerization stage (3) can be carried out on silica-alumina at temperatures between 20° C. and 300° C., and preferably between 120° C. and 250° C., and at pressures from 10 bar to 100 bar, and preferably from 20 bar to 65 bar.

The process according to the invention can be further characterized by the introduction, in the oligomerization stage (3), of at least one gasoline cut (ES) and/or at least one cut containing $C_3$ and $C_4$ originating from a catalytic cracking unit (FCC), a coking unit, a visbreaker, a unit for Fischer-Tropsch synthesis or a steam cracking unit, which is treated mixed with the effluent (F2) from the dehydrogenation stage (2).

The process according to the invention can also be characterized by the introduction, in hydrogenation stage (4), of a cut (F7) 150° C.+ with a sulphur content below 5 ppm (preferably below 1 ppm), for example cuts originating directly from the unit for the atmospheric distillation of crude, or from the catalytic cracking unit (FCC), or from the hydrocracking or catalytic reforming unit.

In another variant of the process according to the invention, the dehydrogenation stage (2) and/or the oligomerization stage (3) can operate in regenerative or semi-regenerative mode. The notation "and/or" signifies that one or other of stages (2) or (3), or both stages (2) and (3) are involved in implementation in regenerative or semi-regenerative mode.

Finally, in a further variant of the process for the production of kerosene and diesel fuels according to the present invention, the hydrogen produced by the dehydrogenation stage (2) can be sent, at least in part, to the consumer unit operations of the refinery optionally after passing through a purification unit using a membrane or a sieve (PSA).

BRIEF DESCRIPTION OF THE DRAWINGS

FIG. 1 shows a process flowsheet.

DETAILED DESCRIPTION OF THE INVENTION

The present description refers to FIG. 1, which shows the process flowsheet, in which the units and streams drawn with dashed lines are optional.

The feed used for the process according to the present invention is a light naphtha (NL) having a distillation range generally between 30° C. and 120° C., to which we can add any proportion of $C_3$ and/or $C_4$ cut called "LPG" cut.

By "light naphtha" is meant a petroleum cut generally having from 3 to 10 carbon atoms, preferably 4 to 7 carbon atoms, and composed of various chemical families, mainly paraffins as well as a certain proportion of aromatics and olefins.

By "LPG cut" is meant a cut having a distillation range from −40° C. to +10° C., in the majority constituted by propane and butane as well as a certain proportion of olefins.

Most often the "light naphtha" cut, labelled with the abbreviation (NL), originates from the distillation of a long naphtha (30° C.-200° C.), previously desulphurized for the production of gasoline by catalytic reforming. If necessary, it is also possible for a light naphtha originating from the direct distillation of crude to be used directly.

In this case, a stage of desulphurization and denitrogenation is carried out in a hydrotreatment unit (HDT) according to technology known to a person skilled in the art, so as to avoid poisoning of the catalysts used in the downstream units.

The light naphtha cut with the LPG cut added, labelled (F1), is then sent to a unit for separating normal and iso-paraffins (1) employing a molecular sieve.

This technology, which is well known to a person skilled in the art, preferably uses small-pore alkaline zeolites such as those designated 5A, which make it possible to obtain a mixture composed in the majority of normal paraffins (F1)".

More generally, any process making it possible to obtain a cut enriched in normal paraffins, such as that using membranes or molecular sieves or combinations thereof, can be envisaged within the scope of the present process.

The stream of branched paraffins (F8) having an improved octane number relative to the starting light naphtha (NL) can be sent to the gasoline pool.

The portion mainly containing linear molecules (F1)' is then sent to a dehydrogenation unit (2) operating at a pressure between 2 bar and 20 bar absolute, preferably between 1 bar and 5 bar (1 bar=$10^5$ Pa) absolute, and even more preferably at atmospheric pressure (to within about 0.5 bar), and at a temperature between 400° C. and 700° C., preferably between 500° C. and 600° C.

In the dehydrogenation unit (2), it may be advantageous to use hydrogen as diluent. The molar ratio of hydrogen to hydrocarbon is generally between 0.1 and 20, preferably between 0.5 and 10.

The mass flow rate of feed (F1) treated per unit of mass of catalyst is generally between 0.5 and 200 kg/(kg·hour).

The catalysts used in the dehydrogenation unit (2) are generally constituted by a group VIII precious metal M selected from the group formed by platinum, palladium, iridium, and rhodium, and at least one promoter selected from the group constituted by tin, germanium, lead, gallium, indium, thallium.

The catalysts of the dehydrogenation unit (2) can also contain a compound of an alkali metal or an alkaline-earth metal.

The precious metal M and the promoter are deposited on an inert support selected from the group formed by silica, alumina, titanium oxide, silica-magnesia, or any mixture of said components.

The catalyst according to the invention preferably contains from 0.01% to 10 wt. %, more preferably 0.02% to 2 wt. %, and very preferably 0.05% to 0.7 wt. % of at least one precious metal M selected from the group constituted by platinum, palladium, rhodium and iridium. Preferably the metal M is platinum or palladium, and very preferably platinum.

The content of promoter is preferably between 0.01% and 10 wt. %, more preferably between 0.05% and 5 wt. %, and very preferably between 0.1% and 2 wt. %.

According to a preferred variant of the process according to the invention, the catalyst for the dehydrogenation unit (2) can advantageously contain both platinum and tin.

The alkali metal compound is selected from the group constituted by lithium, sodium, potassium, rubidium and caesium. Lithium, sodium or potassium are the preferred alkali metals, and lithium or potassium are the alkali metals that are even more preferred.

The content of alkali metal compound is preferably between 0.05% and 10 wt. %, more preferably between 0.1% and 5 wt. %, and even more preferably between 0.15% and 2 wt. %.

The compound of alkaline-earth metal is selected from the group constituted by magnesium, calcium, strontium or barium. Magnesium or calcium are the preferred alkaline-earth metals and magnesium is the most preferred alkaline-earth metal.

The content of compound of alkaline-earth metal is preferably between 0.05% and 10 wt. %, more preferably between 0.1% and 5 wt. %, and even more preferably between 0.15% and 2 wt. %.

The catalyst of the dehydrogenation unit (2) can moreover optionally contain at least one halogen or halogenated compound in proportions of the order of 0.1% to 3 wt. %.

It can also optionally contain a metalloid such as sulphur in proportions of the order of 0.1% to 2 wt. % of the catalyst.

Depending on the cuts sent to the dehydrogenation unit (2), hydrogen productions (H2) of between 1 and 3 tonnes per 100 tonnes of feed can be obtained.

It is possible, within the scope of the present invention, to treat simultaneously, in the dehydrogenation unit (2), any cut that is predominantly paraffinic lighter than $C_5$, and preferably butane and propane cuts.

When operating with a high proportion of propane and butane, it may be necessary to inject some tens of ppm of sulphur, preferably in the form of DMDS. Sulphur is then recovered in the form of hydrogen sulphide at the top of the column for stabilization with the cracked gases.

As the catalyst of the dehydrogenation unit (2) is deactivated by deposition of carbon on the surface of said catalyst, the deposit generally being called "coke", it is necessary to regenerate it by burning off this coke. In order to provide continuous operation of the dehydrogenation unit (2), it is then necessary to have at least two reactors, one of the reactors being in reaction mode, and the other reactor in regeneration mode. However, this technology, which is well known to a person skilled in the art, can be very expensive, and it is also possible to use technology that is semi-regenerative or with continuous regeneration like that which is well known in catalytic reforming, which consists of transferring, in "batch" mode or continuously, the catalyst from the reactor in operation to another vessel, in which regeneration of the catalyst is carried out by burning off the coke.

An important advantage of the continuous regeneration technology is that it makes it possible to reduce the stock of catalyst considerably, and therefore reduce the initial capital outlay. A second advantage is that it makes it possible to maintain the catalyst constantly in its state of maximum activity.

In the case of dehydrogenation of paraffins, it is thus possible to maintain their conversion to olefins at a level very close to or equal to the limit allowed by thermodynamics. Thus, for paraffins from $C_5$ to $C_7$, an average conversion to olefins of 45% to 80% is achievable.

The olefinic effluent (F2) from the dehydrogenation unit (2) is then sent to an oligomerization unit (3), permitting the $C_5$ to $C_7$ olefins to be converted to heavier olefins, namely from $C_{10}$ to about $C_{24}$.

It is possible, within the scope of the present invention, to treat simultaneously, in the oligomerization unit (3), any olefinic cut (ES) from the refinery in the range from $C_3$ to $C_{10}$, for example a gasoline cut from catalytic cracking (FCC), a gasoline cut from a steam cracking unit, a gasoline from a coking unit or visbreaker, or a Fischer-Tropsch gasoline.

Any type of acid catalyst selected from the group formed by phosphoric acid impregnated on silica of the SPA type (supported phosphoric acid), ion exchange resins, silica-aluminas or aluminosilicates such as zeolites, pure or supported on an alumina support, can be envisaged for the oligomerization stage (3).

a) Catalysts of the SPA type produce mainly gasolines and are in fact poorly suited to the high-output production of distillates. They operate in temperature ranges between 100° C. and 300° C., and preferably between 160° C. and 250° C. at pressures between 20 and 100 bar and preferably between 30 and 65 bar.

b) When one wants to maximize the oligomers with a number of carbon atoms greater than 10, it is preferable to use ion exchange resins or silica-aluminas or zeolites.

Only the zeolites, which owing to their particular porosity make it possible to obtain heavy olefins that are linear or have little branching, are suitable for the production of diesel of high quality, i.e. with, after hydrogenation, a cetane number above 45.

When using a zeolite catalyst, the oligomerization unit (3) is operated at temperatures between 150° C. and 500° C., and preferably between 200° C. and 350° C., and at pressures between 20 and 100 bar, and preferably between 30 and 65 bar.

c) It is also possible to obtain high productions of distillates when working with catalysts of the resin or silica-alumina type. In this case, the cetane number of the diesel fraction is still low, below 35. The aim then is to upgrade the middle distillate cut essentially to the form of kerosene, which then has excellent properties compatible with the JET A1 standard, both with respect to low-temperature properties and to smoke point.

The catalysts of the resin type are selected for their good mechanical characteristics in temperature ranges from 20° C. to 250° C., and preferably between 70° C. and 180° C., at pressures between 20 bar and 100 bar, preferably between 30 bar and 65 bar.

These catalysts of the resin type, which are inexpensive and cannot be regenerated, offer the advantage of acceptable cycle times in fixed-bed operation as they are less sensitive to impurities than the zeolites and the silica-aluminas.

Compared with resins, the catalysts of the silica-alumina type offer the advantage that they can be regenerated, so that although they cost more than the resins, substantial savings are made in terms of catalyst consumption.

The operations of loading and unloading are minimized using regeneration in situ.

d) When using a silica-alumina catalyst, the oligomerization unit (3) is operated at temperatures between 20° C. and 300° C., and preferably between 120° C. and 250° C., and at pressures from 10 bar to 100 bar, and preferably from 20 bar to 65 bar.

The effluent (F3) from the oligomerization unit (3) is composed of a mixture of olefinic oligomers from $C_{10}$ to $C_{24}$ and of a light fraction preferably from $C_5$ to $C_{10}$ containing the unconverted $C_5$ to $C_7$ olefins, a fraction of the initial $C_5$ to $C_7$ paraffins of the feed, and the products resulting from reactions of cracking and recombination that can be separated easily by simple distillation.

In order to control the exothermic character of the oligomerization reaction (3), and promote the production of heavy fraction, the effluent from reaction or the gasoline fraction preferably from $C_5$ to $C_{10}$ with residual LPG (labelled F4) is recycled to the inlet of the oligomerization unit (3).

Preferably, a lighter fraction (F5) in the range from $C_5$ to $C_7$ can be recycled with the residual LPG to the dehydrogenation unit (2), in order to convert the normal paraffins to olefins totally or almost totally, and thus maximize the yield of diesel fuel relative to the starting feed.

In order to ensure continuous operation of the oligomerization unit, it is then necessary to have at least two reactors or trains of reactors, one of the reactors (or one of the trains of reactors) being in reaction mode, and the other reactor (or one of the trains of reactors) being in regeneration mode.

When using zeolites, either pure or on an alumina support, it is also possible to implement semi-regenerative or continuous-regeneration technology such as is well known in the catalytic reforming of gasolines, which consists of transferring, in "batch" mode or continuously, the catalyst contained in one or more reactors in operation to another vessel, in which regeneration of the catalyst is carried out by combustion of the coke deposits.

Optionally, the sections for semi-continuous or continuous regeneration of the dehydrogenation unit (2) and of the oligomerization unit (3) can be integrated, i.e. equipment can be shared.

The mixture of heavy olefins (F3) originating from the oligomerization unit (3) is then sent to a hydrogenation unit (4). This is done using a portion of the hydrogen (H2) produced by the dehydrogenation unit (2), and the other, larger portion can be exported to the various hydrotreatment units in the refinery.

Hydrogenation (4) can be carried out in a manner known to a person skilled in the art by hydrotreatment on NiMo, CoMo or NiCoMo catalyst.

Preferably, within the scope of the present invention, hydrogenation (4) is carried out on catalysts based on group VIII metals deposited on an inert support, for example silica or alumina.

The group VIII metals that can be used as hydrogenation catalyst are in particular nickel, palladium or platinum.

Hydrogenation (4) generally takes place in the liquid phase in a fixed-bed reactor at temperatures between 50° C. and 300° C., and preferably between 100° C. and 200° C., and at pressures from 5 to 50 bar, and preferably from 10 to 30 bar.

A degree of hydrogenation of at least 25% is achieved, preferably greater than or equal to 75%, and very preferably greater than or equal to 95%.

The cetane number of the resultant diesel cut is generally between 45 and 55 when using zeolites in the oligomerization unit (3).

EXAMPLE

Example 1

General Case

A refinery has 232 kilotonnes per year (KT/year) of light naphtha (LN) containing 36% of n-paraffins with 5 and 6 carbon atoms as well as 113.4 KT/year of n-butane. The starting light naphtha has a road octane number (RON) of 68.

The $C_4$-$C_5$-$C_6$ light mixture is sent to a dehydrogenation unit (2) operating at a pressure of 1.3 bar and at an average temperature of 550° C. on a catalyst based on platinum and tin deposited on alumina, with a molar recycle ratio H2/HC of 0.5. The effluent from the dehydrogenation unit (2) with a recycle ratio of 1/1 relative to the fresh feed of normal paraffins $C_4$-$C_6$ originating from the oligomerization unit (3) has the following general composition:

| Effluent from the dehydrogenation unit | KT/year |
|---|---|
| Olefins NC4" | 70.1 |
| Olefins NC5" + NC6" | 176.4 |
| Paraffins NC4 | 40.8 |
| Paraffins NC5 + NC6 | 51 |
| Total | 338.3 |

7.1 KT/year of hydrogen is also produced.

The effluent from the dehydrogenation unit (2) containing the olefins and paraffins is then sent to a plant for oligomerization of the olefins (3) operating at around 300° C. on a zeolite catalyst based on ZSM5.

Almost all of the olefins are converted to oligomers

85% is converted to oligomers boiling in the diesel range namely from $C_{10}$ to $C_{24}$, which corresponds to 209.5 KT/year produced 15% is converted to gasoline ($C_5$ to $C_{10}$) boiling in the gasoline range, namely 37 KT/year produced The total quantity of gasoline $C_5$-$C_{10}$ produced containing the starting $C_5$-$C_6$ paraffins comes to 88 KT/year with a road octane number RON measured at 78. 40.8 KT/year of residual butane is also produced.

Optionally the $C_4$-$C_5$-$C_6$ saturated cut can be sent as naphtha to a petrochemical site, reducing the quantity of gasoline produced to 61.3 KT/year.

The effluent from oligomerization (3) is sent to the hydrogenation unit (4).

The hydrogenation unit (4) operates on a nickel-based catalyst at temperatures between 150° and 200° C.

The effluent from the hydrogenation unit (4) has a cetane number of 41, i.e. a motor cetane number of 46.

The hydrogen consumed in hydrogenation (4) is equal to 2.0 KT/year.

The net quantity of hydrogen produced by the process according to the invention is therefore 5.1 KT/year.

In the example discussed, the quantity of gasoline relative to the ingoing light naphtha (NL) was reduced by 62% with simultaneously a 10 point gain in octane number (RON) relative to the ingoing light naphtha (NL).

The process described in the present invention therefore makes it possible not only to produce a diesel fuel of good quality, but also to produce hydrogen, in contrast to the conventional processes, and to reduce the quantities of gasoline and butane, which are currently in surplus, in particular in the European market.

Example 2

Diesel Operation Max. Cetane Number

A refinery has 232 kilotonnes per year (KT/year) of light naphtha (LN) containing 36% of normal paraffins with 5 and 6 carbon atoms.

The starting light naphtha has a road octane number (RON) of 68.

This light naphtha is sent to a unit for separating normal and iso-paraffins (1) operating on a molecular sieve of type 5A. In this way 83.5 KT/year of nC5+nC6 paraffins is obtained, the fraction rich in iso-paraffin (F8) being sent to the gasoline pool.

There is also 113.4 KT/year of n-butane.

The mixture of nC4+nC5+nC6 is sent to a dehydrogenation unit (2) operating at a pressure of 1.3 bar and at an average temperature of 550° C. on a catalyst based on platinum and tin supported on alumina, with a molar recycle ratio H2/HC of 0.5. The effluent from the dehydrogenation unit (2) with a recycle ratio of 1/1 of the $C_4$-$C_6$ normal paraffins originating from the oligomerization unit (3) has the following general composition:

| Effluent from the dehydrogenation unit (2) | KT/year |
|---|---|
| Olefins NC4" | 70.1 |
| Olefins NC5" + NC6" | 63.7 |
| Paraffins NC4 | 40.8 |
| Paraffins NC5 + NC6 | 18.5 |
| Total | 193.1 |

3.8 KT/year of hydrogen is also produced.

The effluent from the dehydrogenation unit (2) containing the olefins and paraffins is then sent to a plant for oligomerization of the olefins (3) operating at about 300° C. on a zeolite catalyst based on ZSM5.

Almost all of the olefins are converted to oligomers.

85% is converted to oligomers boiling in the diesel range namely from $C_{10}$ to $C_{24}$, which corresponds to 113.7 KT/year produced 15% is converted to gasoline ($C_5$ to $C_{10}$) boiling in the gasoline range, namely 20.1 KT/year produced.

The total quantity of gasoline $C_5$-$C_{10}$ produced containing the starting paraffins $C_5$-$C_6$ comes to 38.6 KT/year with a road octane number RON measured at 80. 40.8 tonnes/year of residual butane is also produced.

Optionally, the $C_4$-$C_5$-$C_6$ saturated cut can be sent as naphtha to a petrochemical site, reducing the quantity of gasoline produced in oligomerization (3) to 33.4 KT/year.

The effluent from oligomerization (3) is sent to the hydrogenation unit (4).

The hydrogenation unit (4) operates on a nickel-based catalyst at temperatures between 150° and 200° C. The effluent from the hydrogenation unit (4) has a cetane number of 46, i.e. a motor cetane number of 51.

The hydrogen consumed in hydrogenation (4) is equal to 1.1 KT/year.

The net quantity of hydrogen produced by the process according to the invention is therefore 2.7 KT/year.

The process described in the present invention makes it possible not only to produce a diesel fuel of good quality, but also produce hydrogen, in contrast to the conventional processes, and reduce the quantities of gasoline and butane, which are currently in surplus, in particular in the European market.

According to the process described in the present invention, the 187.1 KT/year of gasoline produced comprises the $C_5$-$C_6$ iso-paraffins and the $C_5$-$C_{10}$ fraction produced in oligomerization.

The quantity of gasoline produced is 20% less than the quantity of ingoing light naphtha (NL), at the same time with an improved octane number of 20 points relative to the ingoing light naphtha (NL).

Example 3

Feed $C_4$/$C_6$/$C_6$ "Max. Kerosene"

A refinery has 232 kilotonnes per year (KT/year) of light naphtha (NL) containing 36% of n-paraffins with 5 and 6 carbon atoms as well as 113.4 KT/year of n-butane. The starting light naphtha has a road octane number (RON) of 68.

The $C_4$-$C_5$-$C_6$ light mixture is sent to a dehydrogenation unit (2) operating at a pressure of 1.3 bar and at an average temperature of 550° C., with a molar recycle ratio H2/HC of 0.5.

Dehydrogenation (2) is carried out on a catalyst based on platinum and tin deposited on alumina.

The effluent from the dehydrogenation unit (2) with a recycle ratio of 1/1 relative to the fresh feed of n-paraffins $C_4$-$C_6$ originating from the oligomerization unit (3) has the following general composition:

| Effluent from the dehydrogenation unit | KT/year |
|---|---|
| Olefins NC4" | 70.1 |
| Olefins NC5" + NC6" | 176.4 |
| Paraffins NC4 | 40.8 |
| Paraffins NC5 + NC6 | 51 |
| Total | 338.3 |

7.1 KT/year of hydrogen is also produced.

The effluent from the dehydrogenation unit (2) containing olefins and paraffins is then sent to a plant for oligomerization of the olefins (3) operating at about 180° C. on a silica-alumina catalyst, and with recycling of the $C_4$ to $C_6$ cuts.

63% of the oligomerization feed (F2) is converted to oligomers boiling in the kerosene range namely from $C_{10}$ to $C_{20}$, which corresponds to 140 KT/year produced 7% of the oligomerization feed (F2) is converted to oligomers boiling in the diesel range namely from $C_{20}$ to $C_{24}$, which corresponds to 15.1 KT/year produced 30% of the oligomerization feed is converted to gasoline ($C_5$ to $C_{10}$) boiling in the gasoline range, namely 66.7 KT/year produced.

44 KT/year of residual butane containing the unconverted $C_4$ olefins is also produced.

The total quantity of gasoline $C_5$-$C_{10}$ produced containing the starting $C_5$-$C_6$ paraffins and the unconverted olefins comes to 139.2 KT/year.

The effluent from oligomerization (3) boiling in the kerosene and diesel range is very olefinic and is sent to the hydrogenation unit (4).

The hydrogenation unit (4) operates on a nickel-based catalyst at temperatures between 150° and 200° C.

After fractionation, the kerosene produced in the hydrogenation unit (4) has a smoke point of 35 mm, a freezing point below −60° C., and an ASTM D86 final boiling point below 300° C., in line with the specifications required for a kerosene complying with the JET A1 standard.

The hydrogen consumed in hydrogenation (4) is equal to 1.6 KT/year.

The small quantity of diesel produced is generally injected into the diesel pool without a significant effect on the cetane number of the pool despite its low cetane number of 30.

The net quantity of hydrogen produced by the process according to the invention is therefore 5.5 KT/year.

In the example discussed, the quantity of gasoline produced relative to the feed of ingoing light naphtha (NL) was reduced by 40%, at the same time with a gain of 20 points in octane number (RON), still relative to the ingoing light naphtha (NL).

The process described in the present invention therefore makes it possible not only to produce a kerosene fuel of good quality, but also produce hydrogen, in contrast to the conventional processes, and reduce the quantities of gasoline and butane, which are currently in surplus, in particular in the European market.

The entire disclosures of all applications, patents and publications, cited herein and of corresponding French application Ser. No. 09/05.465, filed Nov. 13, 2009 are incorporated by reference herein.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A process for the production of a kerosene or diesel fuel and the coproduction of hydrogen from a saturated light feed (F1) with a number of carbons between $C_3$ and $C_7$ comprising:

a) a light naphtha cut (NL) with a number of carbon atoms in the range of 5 to 7 inclusive originating from a unit for primary distillation, for hydrocracking or a Fischer Tropsch unit, with a distillation range between 30° C. and 120° C., said light naphtha cut being previously hydrotreated to remove oxygen-containing, nitrogen-containing and sulphur-containing compounds and, b) a $C_3$/$C_4$ cut (LPG), from which oxygen-containing and sulphur-containing compounds have been removed, said process comprising the following successive stages:

a stage of separation (1) of the normal and iso-paraffins, employing a molecular sieve based on a small-pore alkaline zeolite, enabling recovery of a first effluent (F1) comprising normal paraffins which is sent to the dehydrogenation stage (2) and a second effluent (F8) comprising iso-paraffins which is sent to the gasoline pool or is upgraded to petrochemical naphtha, a stage of dehydrogenation (2) of the normal paraffins originating from the separation stage operating at a pressure between 1.3 and 5 bar absolute, and at a temperature between 400° C. and 700° C., and employing a dehydrogenation catalyst constituted by a group VIII precious metal which is platinum, iridium, or rhodium, and at least one promoter which is tin, germanium, lead, gallium, indium, or thallium, said precious metal and said promoter being deposited on an inert support which is silica, alumina, titanium oxide, silica-magnesia, or a combination thereof, and said stage of dehydrogenation (2) enabling recovery of an effluent (F2) comprising olefins with a number of carbon atoms between 3 and 7, called olefinic effluent (F2), a stage of oligomerization (3) of some or all of the olefinic effluent (F2) obtained in stage (2) in an oligomerization unit (3) employing an oligomerization catalyst which is solid phosphoric acid, an ion exchange resin, silica-alumina or aluminosilicate, said stage of oligomerization (3) enabling the recovery of an effluent (F3) in the majority comprising olefins in the range of $C_{10}$ to $C_{25}$, inclusive and a gasoline effluent (F4) in the majority comprising paraffins in the range from $C_5$ to $C_{10}$ inclusive which is separated from effluent (F3) by distillation and is recycled to the inlet of the oligomerization unit (3), a stage of hydrogenation (4) of some or all of the olefinic effluent (F3) originating from the oligomerization stage (3) carried out in the liquid phase in one or more fixed-bed reactors, at temperatures between 50° C. and 350° C., and at pressures from 5 to 50 bar, and employing a hydrogenation catalyst based on a metal which is platinum, palladium or nickel deposited on an inert support, said stage of hydrogenation (4) enabling the recovery of an effluent (F6) which is a diesel or kerosene fuel cut that is mostly paraffinic and wherein the hydrogen used during stage (4) of hydrogenation comes at least partly from the hydrogen generated in stage (2).

2. A process according to claim 1 wherein the zeolite is an 5A zeolite.

3. A process for the production of a kerosene or diesel fuel, and the coproduction of hydrogen according to claim 1, wherein the catalyst in the dehydrogenation stage (2) comprising platinum or tin deposited on an alumina neutralized with an alkali.

4. A process according to claim 1 wherein the oligomerization catalyst is a zeolite that is pure or supported on alumina.

5. A process according to claim 1, wherein the oligomerization stage (3) is carried out on a resin at temperatures between 20° C. and 200° C., and at pressures from 10 bar to 100 bar, wherein a kerosene fuel to JET A1 specifications and hydrogen are produced.

6. A process according to claim 5, conducted at 70° C. to 180° C. and under a pressure of 30 bar to 65 bar.

7. A process according to claim 1, wherein the oligomerization stage (3) is carried out on silica-alumina at temperatures between 120° C. and 250° C., and at pressures from 20 bar to 65 bar, wherein a kerosene fuel to JET A1 specifications and hydrogen are produced.

8. A process according to claim 1 wherein the hydrogenation catalyst based on a metal is silica, alumina, or a combination thereof.

9. A process according to claim 1, wherein the oligomerization stage (3) is supplied with a gasoline cut (ES) or at least one cut containing $C_3$ and $C_4$ fractions originating from a catalytic cracking unit (FCC), coking unit, visbreaker, a Fischer-Tropsch unit, or from a steam cracking unit, which is treated in a mixture with the effluent (F2) from stage 2.

10. A process according to claim 1, wherein the oligomerization stage (3) is supplied with a cut containing $C_3$ and $C_4$ fractions originating from a catalytic cracking unit (FCC), coking unit, visbreaker, a Fischer-Tropsch unit, or from a steam cracking unit, which is treated in a mixture with the effluent (F2) from stage 2.

11. A process according to claim 1, wherein the hydrogenation stage (4) is supplied with a cut (F7) having a boiling point above 150° C., with a sulphur content below 5 ppm.

12. A process according to claim 11 wherein the cut originates directly from a unit for atmospheric distillation of crude, from a catalytic cracking unit (FCC), or from a unit for hydrocracking or catalytic reforming.

13. A process according to claim 1, wherein the dehydrogenation stage (2) operates in regenerative or semi-regenerative mode.

14. A process according to claim 1, wherein the oligomerization stage (3) operates in regenerative or semi-regenerative mode.

15. A process according to claim 1, wherein the hydrogen produced in stage 2 is passed through a purification unit.

16. A process according to claim 15 wherein the purification unit is a membrane or sieve (PSA).

* * * * *